US006375882B1

(12) United States Patent
Marlow et al.

(10) Patent No.: US 6,375,882 B1
(45) **Date of Patent: *Apr. 23, 2002**

(54) SPINNING MACHINE AND CONVERSION PROCESS

(75) Inventors: Stephen Walter Marlow, Cheltenham; Malcolm George Staveley, Gloucestershire, both of (GB)

(73) Assignee: E. I. du Pont de Nemours and Company, Wilmington, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/308,863

(22) PCT Filed: Nov. 25, 1997

(86) PCT No.: PCT/US97/21903

§ 371 Date: May 26, 1999

§ 102(e) Date: May 26, 1999

(87) PCT Pub. No.: WO98/23797

PCT Pub. Date: Jun. 4, 1998

(30) Foreign Application Priority Data

Nov. 27, 1996 (GB) ..... 9624683

(51) Int. Cl.[7] ..... D01D 5/16

(52) U.S. Cl. ..... 264/211.15; 264/211.16; 264/211.7; 425/66; 425/72.2; 425/377; 425/445

(58) Field of Search ..... 425/72.2, 377, 425/66, 445; 264/211.14, 211.15, 211.16, 211.17

(56) References Cited

U.S. PATENT DOCUMENTS

| | | | | |
|---|---|---|---|---|
| RE22,178 E | * | 9/1942 | Oppenlaender | 18/8 |
| 3,766,614 A | * | 10/1973 | Coats et al. | 28/71.3 |
| 4,123,492 A | * | 10/1978 | McNamara | 264/210 F |

(List continued on next page.)

FOREIGN PATENT DOCUMENTS

| | | | |
|---|---|---|---|
| CH | 263611 | | 6/1981 |
| JP | 52-24129 | * | 6/1977 |
| WO | 9325734 | | 12/1993 |

OTHER PUBLICATIONS

"Ecoflex–Hot Channel Stretching Process", Chemical Fibers International (CFI), Jan. 1996, pp. 37–40, Vol. 46.

Treplow, H., "Loy Moy Poy Hoy Foy? ", Man–Made Fiber Year Book (CTI), 1986, p. 6.

*Primary Examiner*—Nam Nguyen
*Assistant Examiner*—Joseph S. Del Sole

(57) ABSTRACT

This invention relates to a process for making a first and a second plurality of fully oriented multifilament yarns on a fully oriented yarn spinning machine. This process includes spinning a plurality of filaments from a spin pack containing a spinneret plate; cooling the filaments in a quench chimney; applying finish on the filaments and converging the filaments into a first and a second plurality of the multifilament yarns; and drawing the first plurality of the multifilament yarns with a first stepped roll assembly and drawing the second plurality of the multifilament yarns with a second stepped roll assembly to increase their length by a fixed amount. The multifilament yarns from the stepped roll assemblies are heated by applying steam to the multifilament yarns from a steam relax unit between the first and the second stepped roll assemblies; separation of the yarns is maintained; and the first and the second plurality of the multifilament yarns are wound on a first and a second windup assembly into a first and a second plurality of packages. The invention includes an apparatus for carrying out this process wherein a partially oriented yarn spinning machine is converted to a fully oriented yarn spinning machine.

19 Claims, 7 Drawing Sheets

U.S. PATENT DOCUMENTS 4,646,514 A * 3/1987 Chamberlin et al. ..... 57/288
4,891,872 A * 1/1990 Sussman ..... 28/244
5,136,763 A * 8/1992 Nugent ..... 28/245
5,343,601 A * 9/1994 Schippers ..... 28/258
5,558,825 A * 9/1996 Ueda et al. ..... 264/103
5,558,826 A * 9/1996 Jaegge et al. ..... 264/103
5,698,146 A * 12/1997 Schippers et al. ..... 264/103

* cited by examiner

SPINNING MACHINE AND CONVERSION PROCESS

BACKGROUND OF THE INVENTION

1. Field of the Invention

The present invention relates to the manufacture of fully drawn continuous multifilament nylon yarns and to a spinning machine used for the manufacture of these yarns and more particularly to a conversion process used to provide such a yarn spinning machine.

2. Description of Related Art

Makers of continuous multifilament nylon yarns sell their product into apparel manufacturing markets where a mix of textured and untextured yarn is consumed. Untextured yarns are also called flat or fully drawn yarn.

Typically, textured yarn is prepared from a feed yarn, a partially oriented yarn (POY), by draw-twisting and heat setting. Fully drawn or fully oriented yarn (FOY), is prepared by further drawing POY in a split process. Alternatively, FOY is directly spun in a coupled process of spinning and drawing. The terms POY and FOY generally distinguish nylon yarns having an elongation to break of >60% and <60% respectively; see "LOY MOY POY HOY FOY" by H. Treptow, Man-Made Fiber Year Book (CTI) 1986, page 6.

Well-known processes and apparatus to melt spin nylon multifilament POY at high spin speeds are described by Chamberlin et al. in U.S. Pat. No. 4,646,514. However, various spinning machine configurations for POY are employed throughout the industry. These POY machine configurations may be "godetless", a most compact apparatus, where the yarn is wound without passing over roll surfaces or with godets. In such a POY machine with godets the yarn passes over multiple roll surfaces prior to wind-up; see Chemical Fibers International (CFI) Vol. 46, January 1996, pages 37–40.

Flat yarn or FOY spinning machine configurations are disclosed by McNamara et al. in U.S. Pat. No. 4,123,492; and by Kemp et al. in Swiss Patent No. CH-623 611. Generally, the FOY process apparatus requires some means to draw or stretch the yarn. A differential roll speed between a feed roll onto which the yarn is wrapped several times and a draw roll, also where multiple yarn wraps occur, serve to effect the stretch or draw. Some means to relax the fully drawn nylon yarn to allow good yarn package build in winding is necessary for high productivity. This yarn relax means may include a steam box as taught in Kemp at al. or a heated roll assembly.

The makers of multifilament nylon yarns usually prepare both POY and FOY for various end uses. The spinning machine asset investment by each maker usually reflects the relative fraction of POY to FOY consumed by the apparel market into which the maker sells product. However, market demands shift over time as fashion trends may dictate a changing requirement for POY versus FOY consumed in the market. As a result, a fixed machine asset may present certain liabilities. While recognized as a long standing dilemma to the makers of POY and FOY nylon yarns, the ability to shift a POY spinning machine asset to a FOY spinning asset has not been addressed in the literature.

SUMMARY OF THE INVENTION

The present invention deals with this situation where a maker of nylon multifilament yarns must respond to a drop in the demand for textured apparel yarns (POY) and a corresponding growing requirement for fully drawn yarn (FOY) consumed in the market.

We have found an effective and economical method to convert a POY machine to spin FOY yarns resulting in a novel apparatus for making fully drawn yarn. This conversion process of our invention is reversible and may allow spinning assets to "swing" between product types in response to-market demands.

A prior art godetless POY machine is shown in FIG. 1. Such a prior art machine is readily converted to a FOY machine via the process of our invention. Our incentive to make this conversion resulted largely from space restrictions, both vertical and horizontal, imposed by traditional POY machine design. We have found productivity and investment criteria impose stringent design standards on facilities of POY machines. Often the yarn winding assemblies are less than 300 mm apart (on average). Introducing a typical prior art feed and draw roll assembly to the midsection of closely spaced POY machines would result in undue complexity and be expensive. Moving the winder assemblies farther apart to accommodate prior art feed and draw roll mechanisms and a yarn relax means is not a simple and economical option and would inhibit a readily reversible conversion of machines.

Where incentive exists to shift POY spinning assets to FOY spinning assets without substantive modification of winding assemblies, there is a need for a simple, inexpensive, and compact yarn drawing and yarn relaxing assembly to meet the space restriction and investment limitations imposed by an existing POY spinning facility.

The present invention, i.e., a conversion method and an apparatus, and other objects of the invention will be clear from the following description.

The invention relates to a fully oriented yarn spinning machine for making a first and second plurality of fully oriented multifilament yarns, comprising: at least a first spinning assembly having a spin pack containing a spinneret plate for providing a plurality of filaments; a quench chimney for receiving and cooling the filaments; a finish applicator and convergence guide for receiving the filaments from the spinneret plate, for applying finish to the filaments, and for converging the filaments into a first and a second plurality of multifilament yarns; a first and a second alignment guide for receiving the first and second plurality of the multifilament yarns from the finish applicator and convergence guide; a first and a second stepped roll assembly for receiving the first and the second plurality of the multifilament yarns from the first and the second alignment guides, respectively, and for drawing the multifilament yarns to increase their length by a fixed amount; a steam relax unit between the first and the second unheated rotatable stepped feed and draw roll assemblies, the steam relax unit for receiving the multifilament yarns from the unheated rotatable stepped feed and draw roll assemblies and for applying steam to the multifilament yarns to stabilize the multifilament yarns; a first and a second pre wind-up guide for maintaining the separation of the multifilament yarns; and a first and a second windup assembly for winding the first and the second plurality of the multifilament yarns into a first and a second plurality of packages.

The fully oriented yarn spinning machine may optionally have an exit guide for maintaining the separation of the multifilament yarns within the steam relax unit and for directing the first and second plurality of the multifilament yarns.

The invention further relates to a yarn spinning machine conversion process for converting a partially oriented yarn spinning machine to a fully oriented yarn spinning machine, the partially oriented yarn spinning machine having a first spinning assembly in a confined space between adjacent spinning assemblies, the process comprising: relocating and/or replacing a first and a second alignment guide for receiving a first and a second plurality of multifilament yarns; mounting in the confined space a first and a second unheated rotatable stepped feed and draw roll assembly for receiving the first and the second plurality of the multifilament yarns from the first and the second alignment guides, respectively, and for drawing the multifilament yarns to increase their length by a fixed amount; installing in the confined space a steam relax unit between the first and the second unheated rotatable stepped feed and draw roll assemblies, the steam relax unit for receiving the multifilament yarns from the unheated rotatable stepped feed and draw roll assemblies and for applying steam to the multifilament yarns to stabilize the multifilament yarns before they are directed to a first and a second windup assembly, respectively, for winding the first and the second plurality of the multifilament yarns into a first and a second plurality of packages.

Optionally the conversion process includes adding an exit guide for maintaining the separation of the multifilament yarns within the steam relax unit.

BRIEF DESCRIPTION OF THE DRAWINGS

The invention can be more fully understood from the following detailed description thereof in connection with accompanying drawings in which.

DESCRIPTION OF THE PREFERRED EMBODIMENT(S)

Figure 1:
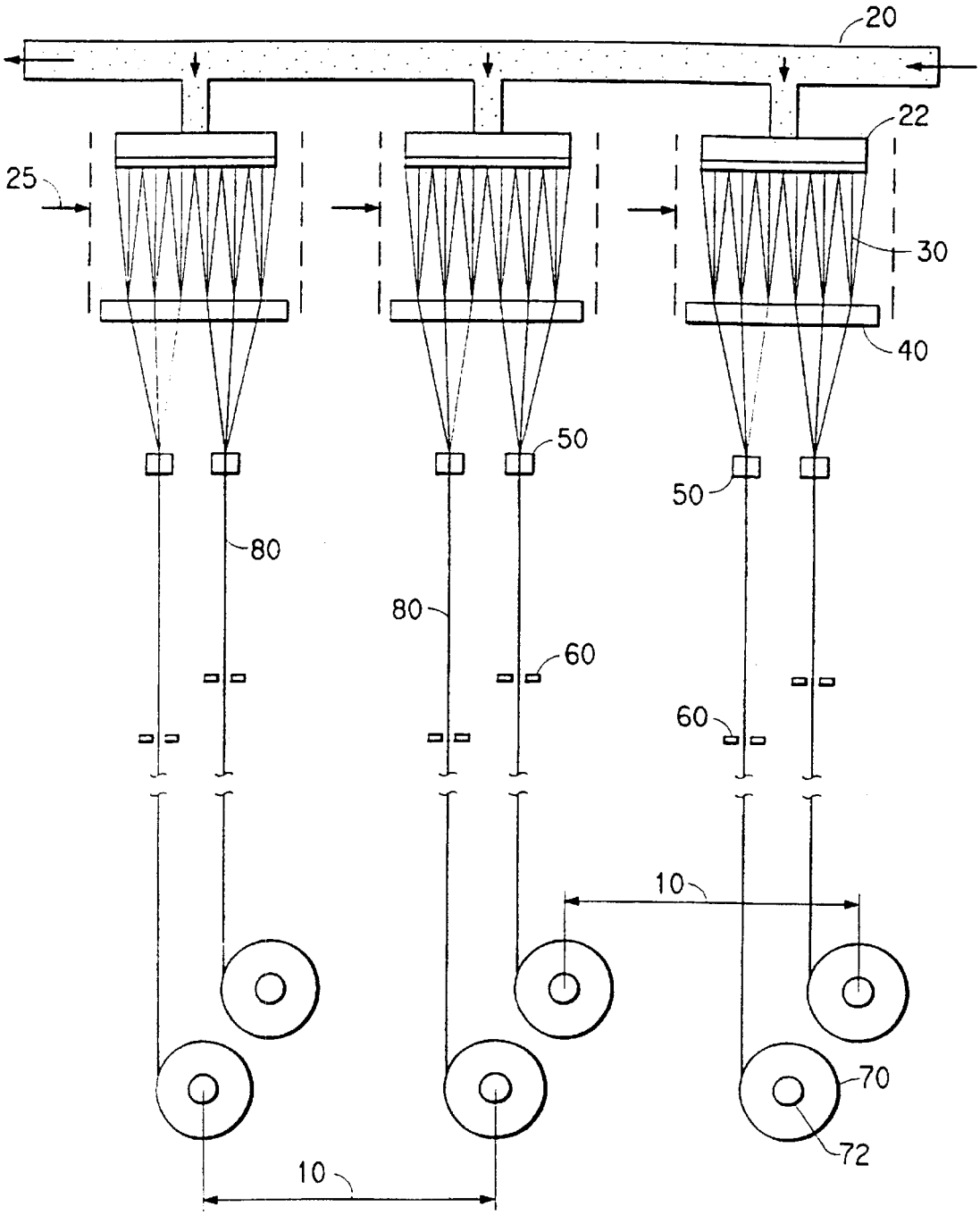
FIG. 1 (PRIOR ART)
FIG. 1 is a schematic drawing of a plurality of prior art godetless POY spinning machines.

Throughout the following detailed description, similar reference characters refer to similar elements in all figures of the drawings.

The invention is a fully oriented yarn (FOY) spinning machine and a yarn spinning machine conversion process for converting a partially oriented yarn (POY) spinning machine to the fully oriented yarn (FOY) spinning machine.

Figure 2A:
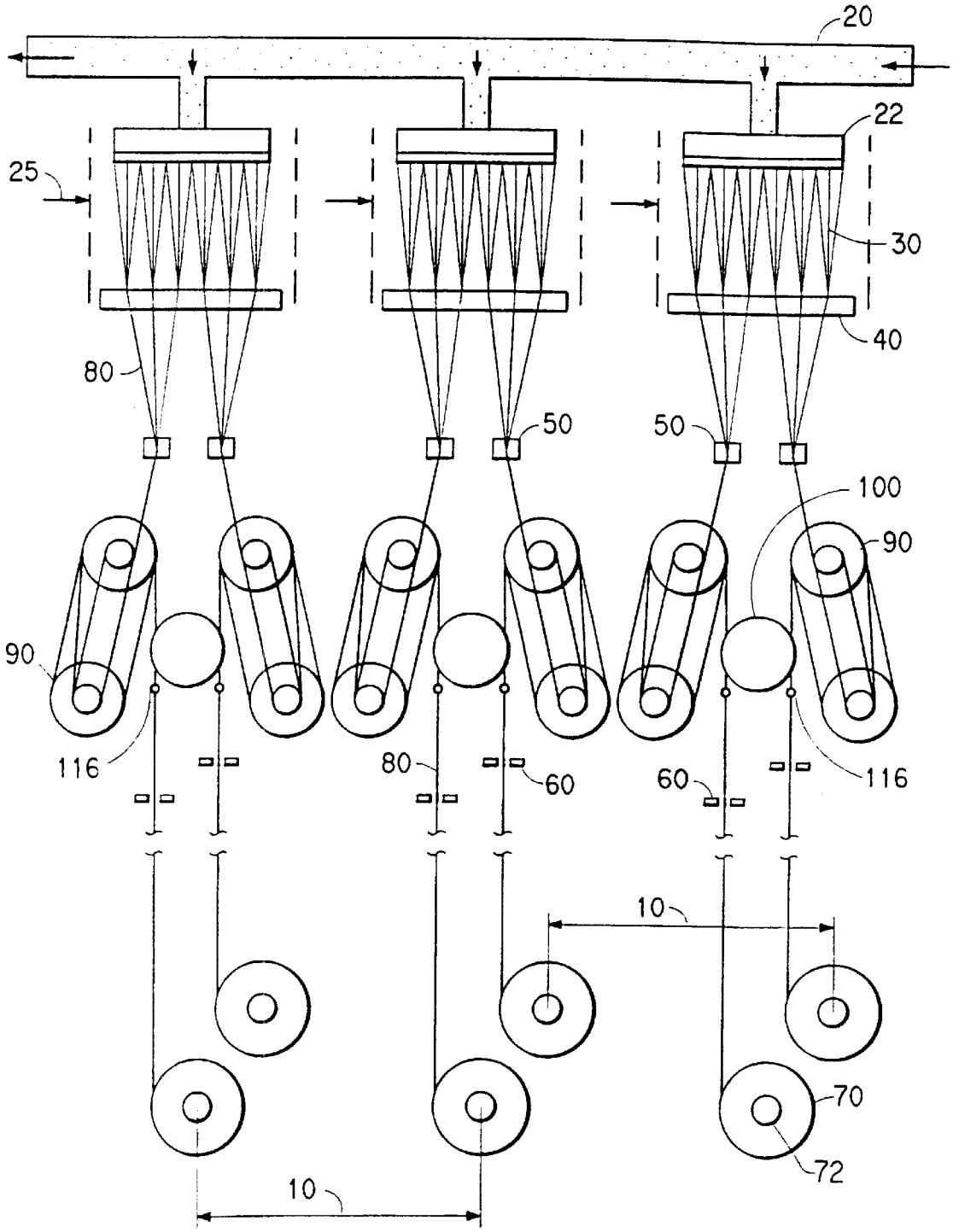
FIG. 2*a* is a schematic drawing of a plurality of FOY spinning machines converted from those machines represented by the FIG. 1 drawing.

The FOY spinning machine is for making a first and a second plurality of fully oriented multifilament yarns. The fully oriented yarn spinning machine comprises at least a first spinning assembly, but preferably comprises a plurality of substantially similar spinning assemblies in a row. FIG. 2*a* depicts the first spinning assembly between a second spinning assembly and a third spinning assembly.

The first, and preferably each, spinning assembly of FIG. 2*a* has a spin pack (22) fed with molten polymer from polymer manifold (20), a quench chimney (25), a finish applicator and convergence guide (40), a first and a second alignment guide (50), a first and a second stepped roll assembly (90), a steam relax unit (100), an exit guide (116), a first and a second pre wind-up guide (60), and a first and a second windup assembly, not shown in FIG. 2*a*, but illustrated positionally by the location of multiple yarn packages (70) wound on a spindle (72).

The spin pack (22) contains a spinneret plate for providing a plurality of filaments (30). The quench chimney (25) is for receiving and cooling the filaments (30). The finish applicator and convergence guide (40) is for receiving the filaments (30) from the spinneret plate, for applying finish to the filaments, and for converging the filaments into a first and a second plurality of multifilament yarns (80). There can therefore be 3, 4, 6, 8 or 12 yarns, for example, fed to one alignment guide (50). The first and the second alignment guides (50) are for receiving the first and the second plurality of the multifilament yarns (80) from the finish applicator and convergence guide (40) and for spacing the plurality of multifilament yarns prior to contacting the following roll surfaces.

The first and a second stepped roll assemblies (90) shown in FIG. 2*a* are for receiving the first and the second plurality of the multifilament yarns (80) from the first and the second alignment guides (50), respectively, and for drawing the multifilament yarns to increase their length by a fixed amount.

Figure 2B:
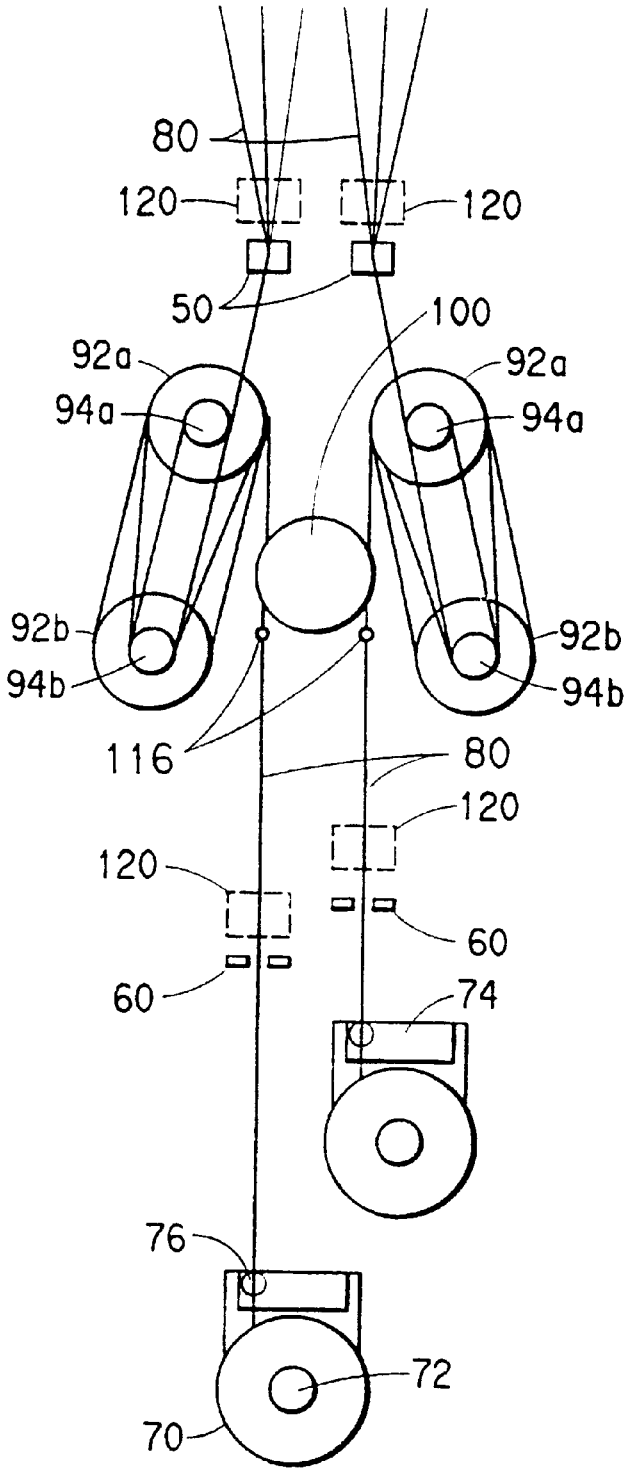
FIG. 2*b* is a schematic drawing of a single FOY spinning machine mid-section.
Figure 2C:
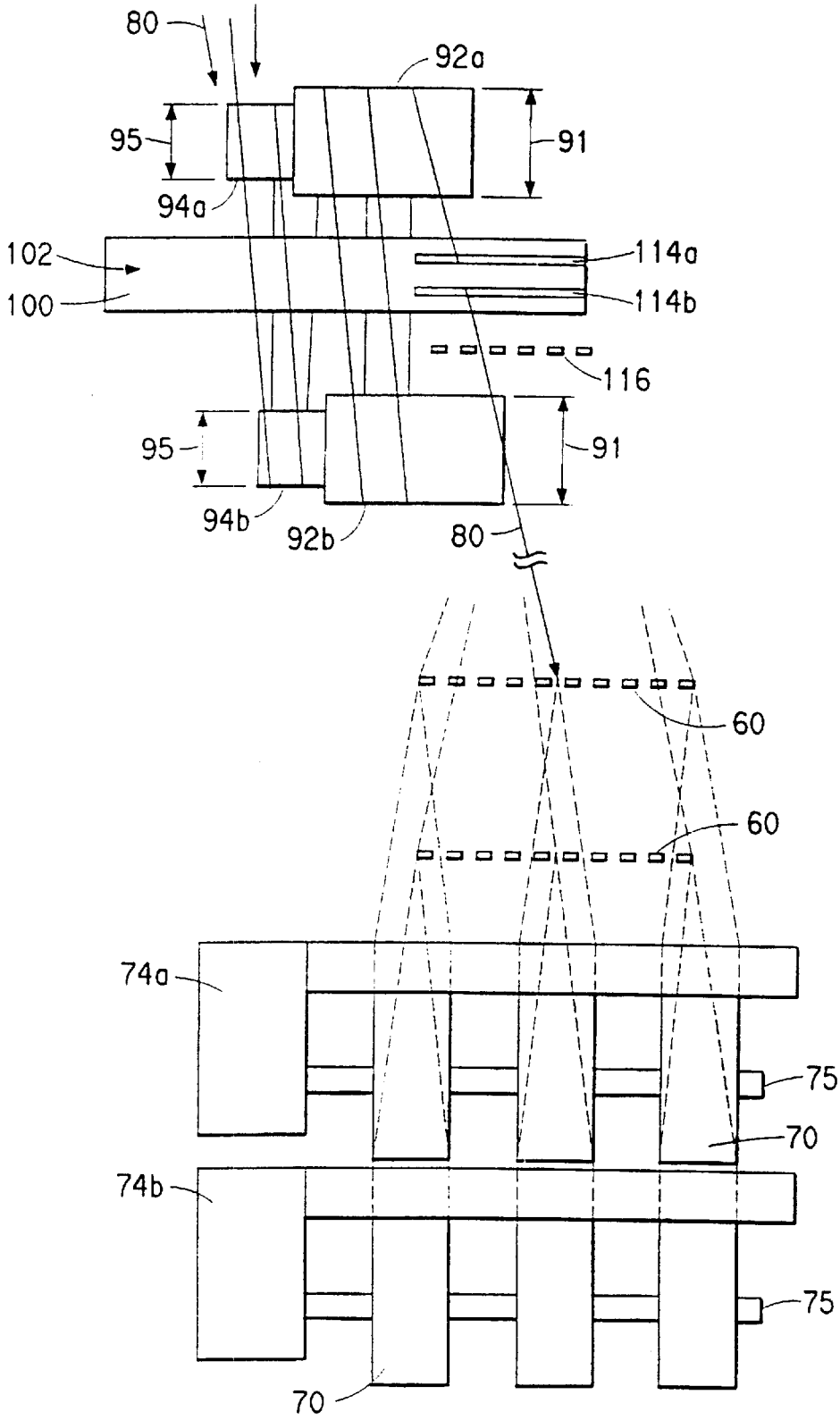
FIG. 2*c* is a schematic drawing of the single FOY machine mid-section as viewed from a right angle to FIG. 2*b;*

In one embodiment illustrated by FIGS. 2*b* and 2*c*, the first and the second unheated rotatable stepped feed and draw roll assemblies comprise a first feed roll (94*b*), a second feed roll (94*a*), a first draw roll (92*a*) and a second draw roll (92*b*). The first feed roll (94*a*) and second feed rolls (94*b*) have first diameters (95) and the first and second draw rolls have second diameters (91) greater than the first diameters (95). The first diameter (95) and the second diameter (91) are selected to provide a fixed draw ratio of the multifilament yarns. The first and second unheated rotatable stepped feed and draw roll assemblies are positioned vertically between each of the alignment guides (50) and the pre wind-up yarn guides (60). The first feed rolls (94*b*) and the first draw rolls (92*a*) are positioned higher than the second draw rolls (92*b*). The typical vertical distance between the alignment guide (50) and the pre wind-up guides (60) is 1400 mm, and the typical distance between the axes (96*a*) and (96*b*) of the two stepped rolls is about 400 mm.

Figure 3A:
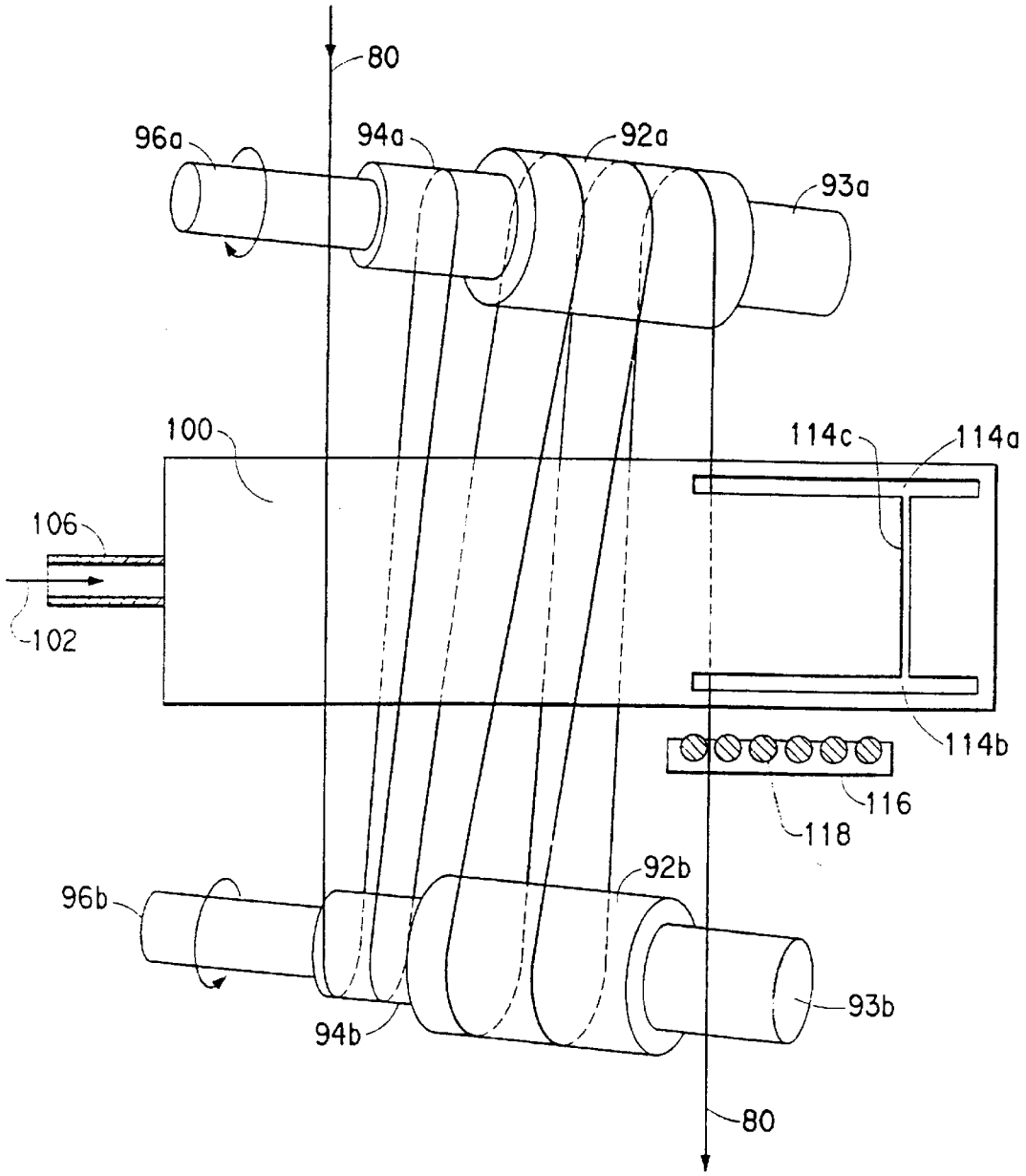
FIG. 3*a* is a schematic drawing of one stepped feed and draw roll assembly relative to the steam relax chamber.
Figure 3B:
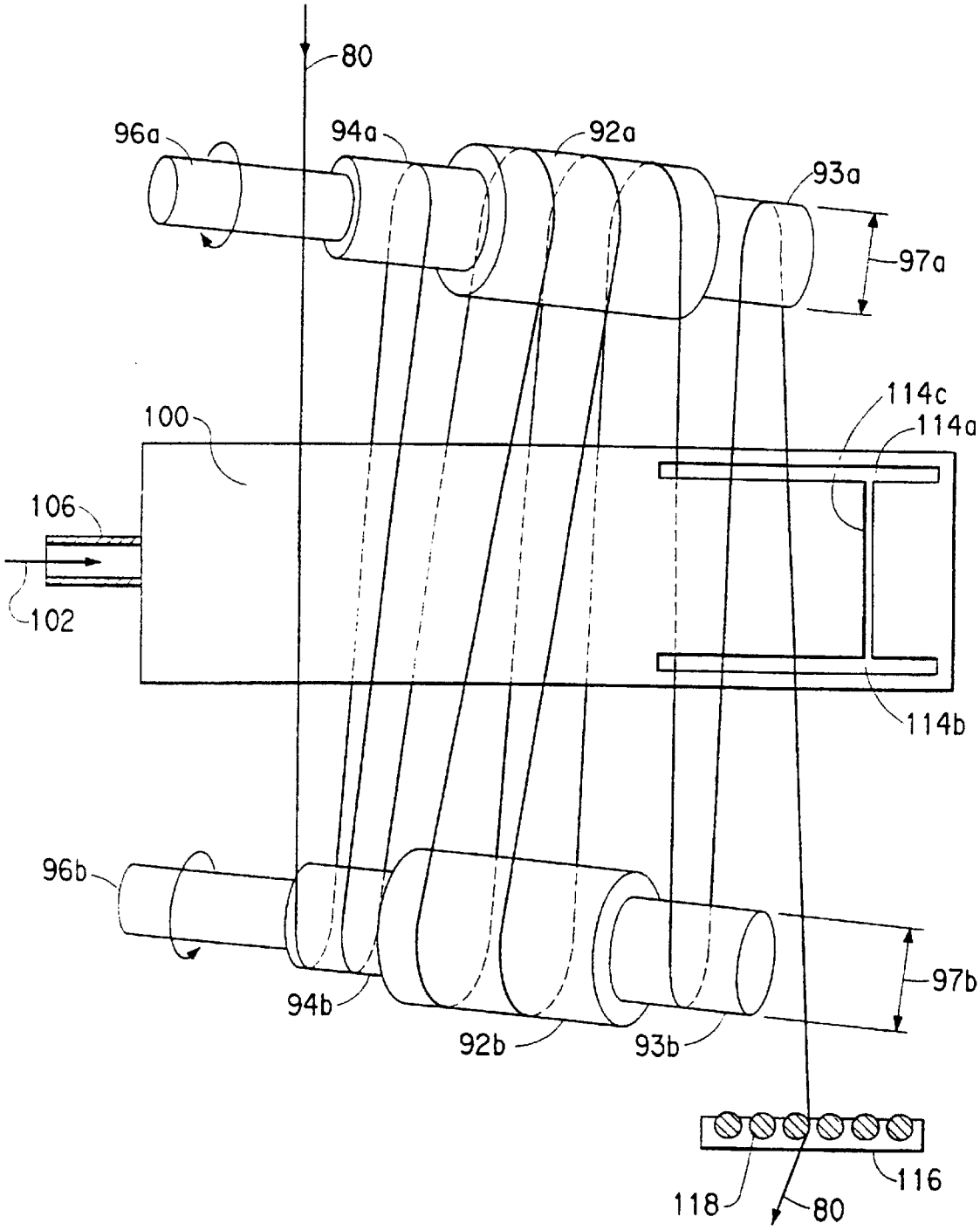
FIG. 3*b* is a schematic drawing of an alternative embodiment, one stepped feed and draw roll assembly relative to the steam relax chamber with a yarn tension let-down step roll.

Axes of rotation (96*a*) (as shown in FIGS. 3*a* and 3*b*) of the first feed rolls (94*b*) and the first draw rolls (92*a*) are positioned in or substantially in a first plane and locating axes of rotation (96*b*) of the second feed rolls (94*a*) and the second draw rolls (92*b*) are in or substantially in a second plane. In conventional practice the one stepped roll assembly is tilted versus the other assembly in the vertical plane by a tilt angle and skewed versus the other assembly in the horizontal plane by a skew angle. The first feed roll (94*b*), the second feed roll (94*a*), the first draw roll (92*a*) and the second draw roll (92*b*) are adapted to rotate at the same speed with axes of rotation (96*a*, 96*b*) angled, by skew and tilt, to provide advancement of the multifilament yarns (80), from the first feed roll (94*b*), the second feed roll (94*a*), the first draw roll (92*a*) and the second draw roll (92*b*). According to FIG. 2*c*, each multifilament yarn end (80), only one end of which is shown, typically wraps the feed rolls (94*b*, 94*a*) 1 and ½ times and wraps the draw rolls (92*a*, 92*b*) 2 and ½ times. Preferably, the first and the second unheated rotatable stepped feed and draw roll assemblies in each spinning assembly are mirror images of one another.

In a second embodiment shown schematically in FIG. 3*b*, each of the unheated rotatable stepped feed and draw roll assemblies is a double stepped roll assembly. A second roll step to smaller diameter on the outside helps to achieve better yarn relaxation, and hence better yarn package formation, by isolating the relax tension from the winding tension. In this FIG. 3*b* embodiment, each of the rotatable stepped feed and draw roll assemblies comprises a first feed roll (94*b*), a second feed roll (94*a*), a first draw roll (92*a*), a second draw roll (92*b*), a first relax roll (93*b*) and a second relax roll (93*a*). The first and second feed rolls (94*b*, 94*a*) have a first diameter (95) and the first and second relax rolls (93*b*, 93*a*) have a second diameter (97*a* or 97*b*) greater than the first diameter (95). The first and second draw rolls (92*a*, 92*b*) have a third diameter (91) greater than the second diameter (97*a*, 97*b*). The first feed roll (94*b*), the second feed roll (94*a*), the first draw roll (92*a*), the second draw roll (92*b*), the first relax roll (93*b*) and the second relax roll (93*a*) are adapted to rotate at the same speed with axes of rotation (96*a*, 96*b*) angled to provide advancement of the multifilament yarns (80), from the first feed roll (94*b*), the second feed roll (94*a*), the first draw roll (92*a*), the second draw roll (92*b*), the first relax roll (93*b*) and the second relax roll (93*a*) and provide a preselected draw ratio of the multifilament yarns (80) and preselected amount of yarn relaxation prior to winding.

The double sided steam relax unit (100), shown relative to the stepped roll assemblies, variously, in FIGS. 2*a*, 2*b* and 2*c*, receives the multifilament yarns (80) from the first and the second unheated rotatable stepped feed and draw roll assemblies and applies a steam atmosphere to the yarn. Steam which is introduced to the steam related unit at (102), as shown in FIG. 2*c*, for example, promotes plasticity of the multifilament yarns (80) stabilizing the yarns and effecting tension relaxation of the yarn. The tension relaxation results in stable yarn package formation from lessened yarn retraction forces.

It is common practice in the manufacture of POY and FOY for interlacing to be required for some products. This may be achieved in a machine of the invention by optionally fitting interlacing jets (120) for example, before the first feed roll (94*b*) and/or after the steam relax unit (100) as shown schematically in FIG. 2*b*.

Figure 4A:
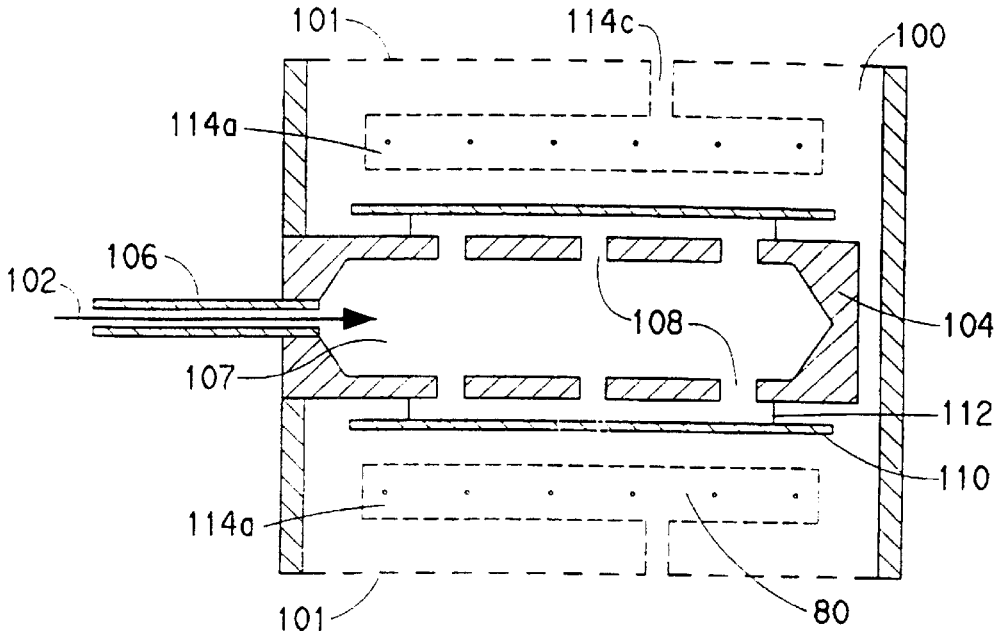
FIGS. 4*a* and 4*b* are cut-away schematics drawings of he steam relax chamber at a right angle to one another.
Figure 4B:
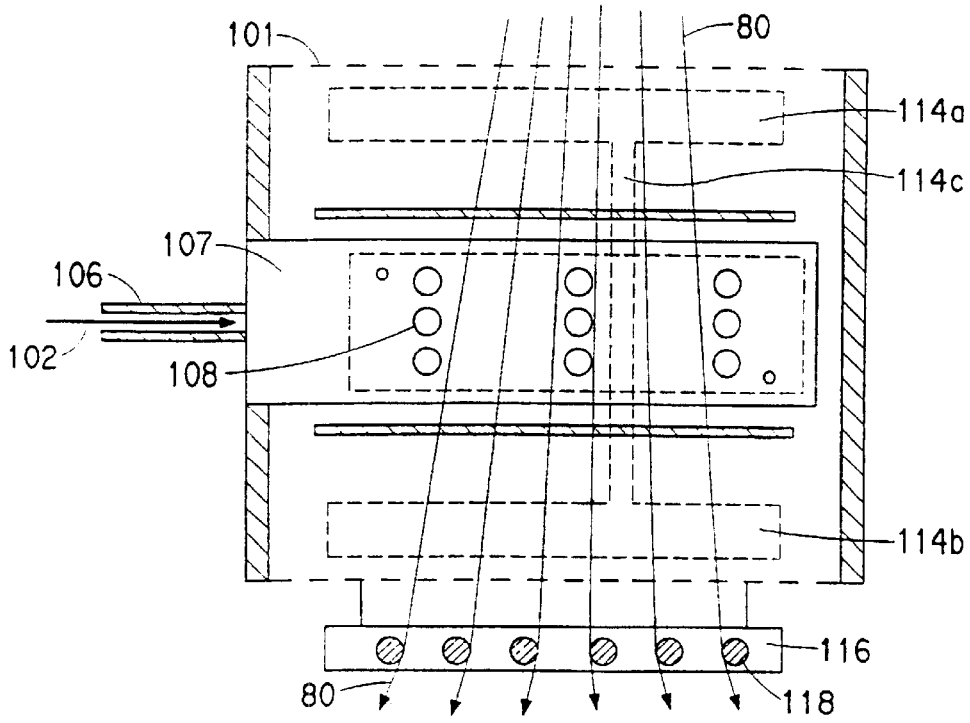

The shared, or double sided, steam application unit (100) implemented here is shown in cut-away detail from two views at right angles to one another in FIG. 4*a* and FIG. 4*b*. This design (100) cuts costs and reduces congestion on the front of the machine and increases space at the back since process, jacket, condensate and extract services are halved by sharing. The shared, or double sided, steam relax unit (100) is between the first and second unheated rotatable stepped feed and draw roll assemblies. Preferably, the steam relax unit (100) is as close to the final contact of the yarns (80) with the draw rolls as possible to minimize the build up of tension from air drag before the steam relaxation since lower tension encourages more relaxation reducing subsequent retraction on the packages. To accomplish this, preferably, the steam relax unit (100) is vertically between the first draw rolls (92*a*) and the second draw rolls (92*b*).

The steam relax unit (100), as viewed in FIG. 4*a* includes a tube (106) through which steam enters leading to a chamber (104) having openings (108). There is also a baffle (110), standing off from the internal steam chamber (107) on pins (112), for blocking the multiple steam outlet openings (108) from impacting directly on the multifilament yarns (80). The steam relax unit (100) is adapted to cause steam to be applied to the multifilament yarns (80) with the multifilament yarns (80) at tensions at or below 0.2 grams per decitex at or about atmospheric pressure. Preferably, the steam relax unit (100) has halves which are substantial mirror images of one another (FIG. 4*a*). No internal jets or other guides are used; a double skinned cover (101) for insulation is provided. Slots (114*c*) communicating between yarn entrance slots (114*a*) and exit slots (114*b*) provide means to string-up the plurality of threadlines. Slots (114*a*) and (114*b*) serve further to vent steam to the atmosphere. An exit guide (116) and pins (118) for maintaining the separation of the multifilament yarns (80) within the steam relax unit (100) and for directing the first and second plurality of the multifilament yarns (80) to pre wind-up guides (60) and to the winding unit (74) (shown in FIGS. 2*b* and 2*c*) are the only guides associated with the steam relaxation unit (100).

The first and second pre wind-up guide (60) (as shown in FIG. 2*c*) maintains the separation of the multifilament yarns (80), fanning the first and second plurality of the multifilament yarns (80). The first (74*a*) and the second (74*b*) windup assembly are for winding the first and the second plurality of the multifilament yarns (80) into a first and a second plurality of packages (70). Preferably the first and the second windup assembly (72*a*, 72*b*) comprise a double deck windup assembly (74*a*, 74*b*) with yarn traversing means (76) for winding the multifilament yarns onto yarn cores mounted on spindle (75) into yarn packages (70). The first and the second windup assemblies (74*a*, 74*b*) have a windup spindle or chuck (75) for winding the first and the second plurality of the multifilament yarns (80) into a first and second plurality of packages (70). A horizontal distance (10) (shown in FIG. 2*a*) between axes of rotation of the windup chuck (72 or 75) in the first windup assembly (74*a*) in the first spinning assembly and the windup chuck (72 or 75) in the first windup assembly (74*a*) in the second and the third spinning assemblies is a maximum distance of less than or equal to 1000 mm and preferably less than or equal to 600 mm. The first and the second windup assemblies (74*a*, 74*b*) each include a traversing guide (76) for moving the first and the second plurality of the multifilament yarns (80) back and forth transverse to the multifilament yarns for winding the multifilament yarns on cores into the packages (70). The spinning machines of the present invention are capable of spinning yarns of 10 to 250 decitex, of operating at 4,000 mpm to 6,000 mpm, in all melt spinning processes for fibers from all polyamides, especially nylon 6,6, nylon 6, nylon 6,10 and nylon 6,12 and polyesters, especially polyethylene terephthalate and polypropylene terephthalate.

The invention is further directed to a yarn spinning machine conversion process for converting a partially oriented yarn spinning machine to the fully oriented yarn spinning machine.

Illustrated schematically in FIG. 1 is a plurality of partially oriented yarn spinning machines similar to those in wide commercial use that can be easily converted to the fully oriented yarn spinning machine of the present invention as shown in FIG. 2*a*. The partially oriented yarn spinning machine is for making a first and a second plurality of partially oriented multifilament yarns. For purposes herein, "partially oriented yarn" or POY means a yarn of greater than 60% elongation to break, whereas, "fully oriented yarn" or FOY means a yarn of less than 60% elongation to break. The POY spinning machine comprises a plurality of substantially similar spinning assemblies in a row, including as illustrated in FIG. 1 a first spinning assembly in a confined space between a second spinning assembly and a third spinning assembly. Each spinning assembly has a spin pack (22), a quench chimney (25), a finish applicator and convergence guide (40), a first and a second alignment guide (50), a first and a second pre windup guide (60), and a first and a second windup assembly not shown, but in relative position to where a plurality of yarn packages (70) are wound on tube cores (72). The yarn spinning machine conversion process for converting a POY spinning machine to a FOY spinning machine comprises the following steps in any order. The first and the second alignment guide (50) are relocated and/or replaced such that the relocated or replaced first and second alignment guides (50), in FIG. 2*a* are for receiving the first and the second plurality of multifilament yarns (80) and directing the multifilament yarns to the first and a second unheated rotatable stepped feed and draw roll assemblies (90) in FIG. 2*a*. Guides (50) in FIG. 2*a* now space out the threadlines to contact the feed roll surfaces individually. The first and the second unheated rotatable stepped feed and draw roll assemblies (90) are mounted in the confined space, essentially that space provided between neighboring machines and limited by the fixed difference (10) between the winding axes indicating by distance (10). The first and a second unheated rotatable stepped feed and draw roll assemblies (94*a*, 94*b* and 92*a*, 92*b*) are for receiving the first and the second plurality of the multifilament yarns (80) from the first and the second alignment guides (50), respectively, and for drawing the multifilament yarns (80) to increase their length by a fixed amount.

The steam relax unit (100) is installed in the confined space between the first and the second unheated rotatable stepped feed and draw roll assemblies (90). The steam relax unit (100) is for receiving the multifilament yarns (80) from the unheated rotatable stepped feed and draw roll assemblies (90) and for applying steam to the multifilament yarns (80) to stabilize the multifilament yarns (80). The exit guide (116) is added immediately after the steam relax unit (100) for maintaining the separation of the multifilament yarns (80) within the steam relax unit (100) and for directing the first and second plurality of the multifilament yarns (80) to a first and a second windup assembly (74*a* and 74*b*), respectively, for winding the first and the second plurality of the multifilament yarns (80) into a first and a second plurality of packages (70).

As a result of using this machine conversion process, a maker of multifilament nylon yarns can convert a POY spinning machine asset base to a FOY machine asset base in response to market demand shifts in the relative fraction of the product, POY versus FOY. The conversion method of the present invention does not require winder relocation for spacing requirements and effectively and economically converts the typical POY machine to spin FOY yarns providing a novel apparatus. Further benefits are realized with the conversion process of our invention by reversibly performing such a conversion. A fiber maker can then "swing" between product types in response to market-demands.

What is claimed is:

1. A process for making a first and a second plurality of fully oriented multifilament yarns on a fully oriented yarn spinning machine, comprising:

spinning a plurality of filaments from a spin pack containing a spinneret plate;

cooling the filaments in a quench chimney;

applying finish on the filaments and converging the filaments into a first and a second plurality of multifilament yarns;

drawing the first plurality of the multifilament yarns with a first unheated rotatable stepped feed and draw roll assembly and drawing the second plurality of the multifilament yarns with a second unheated rotatable stepped feed and roll assembly to increase their length by a fixed amount;

heating said multifilament yarns from the unheated rotatable stepped feed and draw roll assemblies by applying steam to said multifilament yarns from a steam relax unit between the first and the second heated rotatable stepped feed and draw roll assemblies;

maintaining a separation of the yarns; and winding the first and the second plurality of the multifilament yarns on a first and a second windup assembly into a first and a second plurality of packages.

2. A yarn spinning machine for making at least a first and a second plurality of fully oriented multifilament yarns, comprising:

at least a first spinning assembly having:

a spin pack containing a spinneret plate for providing a plurality of filaments;

a quench chimney for receiving and cooling the filaments;

a finish applicator and convergence guide for receiving the filaments from the spinneret plate, for applying finish to the filaments ;and for converging the filaments into a first and a second plurality of multifilament yarns;

a first and a second alignment guide for receiving the first and the second plurality of the multifilament yarns from the finish applicator and convergence guide and for directing said multifilament yarns, a first and a second unheated rotatable stepped feed and draw roll assembly for receiving the first and the second plurality of the multifilament yarns from the first and the second alignment guides respectively, and for drawing said multifilament yarns to increase their length by a fixed amount;

a steam relax unit between the first and the second unheated rotatable stepped feed and draw roll assemblies; the steam relax unit for receiving said multifilament yarns from the unheated rotatable stepped feed and draw roll assemblies and for applying steam to said multifilament yarns to stabilize said multifilament yarns;

a first and a second pre wind-up guide below the steam relax unit for maintaining a separation of said multifilament yarns and for directing the first and the second plurality of the multifilament yarns; and a first and a second windup assembly for winding the first and the second plurality of the multifilament yarns into a first and a second plurality of packages.

3. The yarn spinning machine according to claim 2, which includes an exit guide for maintaining a separation of said multifilament yarns within the steam relax unit.

4. The yarn spinning machine according to claim 2, wherein the first and the second unheated rotatable stepped feed and draw roll assemblies comprise a first feed roll, a second feed roll, a first draw roll and a second draw roll, the first and second feed rolls having first diameters and the first and second draw rolls having second diameters greater than the first diameters; and the steam relax unit is vertically between the first draw rolls and the second draw rolls.

5. The yarn spinning machine according to claim 2, wherein the first and the second windup assembly comprise a double deck windup assembly for winding the multifilament yarns on cores into packages.

6. The yarn spinning machine according to the claim 2, wherein the first and the second wind up assembly has a windup chuck for winding the first and the second plurality of the multifilament yarns into a first and a second plurality of packages; and there are second and third spinning assemblies, the first spinning assembly being between the second and the third spinning assemblies; and a horizontal distance between axes of rotation of the windup chuck in the first windup assembly in the first spinning assembly and the windup chuck in the first windup assembly in the second and the third spinning assemblies is a maximum distance of less than or equal to 1000 mm.

7. The yarn spinning machine according to claim 6, wherein the horizontal distance between axes of rotation of the windup chuck in the first windup assembly in the first spinning assembly and the windup chuck in the first windup assembly in the second and the third spinning assemblies is less than or equal to 600 mm.

8. The yarn spinning machine according to claim 2, wherein the steam relax unit includes a baffle for blocking a steam inlet jet from impacting on said multifilament yarns and the steam relax unit has halves which are substantial mirror images of one another.

9. The yarn spinning machine according to claim 2, wherein the first and the second unheated rotatable stepped feed and draw roll assemblies are mirror images of one another.

10. The yarn spinning machine according to claim 2, wherein each of the first and the second unheated rotatable stepped feed and draw roll assemblies is a double stepped roll assembly.

11. A process for making a first and a second plurality of fully oriented multifilament yarns using the yarn spinning machine according to claim 2.

12. A conversion process for converting a partially oriented yarn spinning machine to a fully oriented yarn spinning machine, the partially oriented yarn spinning machine having a first spinning assembly in a confined space between adjacent spinning assemblies, the process comprising:

relocating and/or replacing a first and a second alignment guide for receiving a first and a second plurality of multifilament yarns and directing the multifilament yarns;

mounting in the confined space a first and a second unheated rotatable stepped feed and draw roll assembly for receiving the first and the second plurality of the multifilament yarns from the first and the second alignment guides, respectively, and for drawing said multifilament yarns to increase their length by a fixed amount; and installing in the confined space a steam relax unit between the first and the second unheated rotatable stepped feed and draw roll assemblies; the steam relax unit for receiving said multifilament yarns from the unheated rotatable stepped feed and draw roll assemblies and for applying steam to said multifilament yarns before they are directed to a first and a second windup assembly, respectively, for winding the first and the second plurality of the multifilament yarns into a first and a second plurality of packages.

13. The process according to claim 12, which includes adding an exit guide for maintaining a separation of said multifilament yarns within the steam relax unit and for directing said multifilament yarns.

14. The process according to claim 12 wherein:

the first and the second unheated rotatable stepped feed and draw roll assemblies comprise a first feed roll, a second feed roll, a first draw roll and a second draw roll, the first and second feed rolls having first diameters and the first and second draw rolls having second diameters greater than the first diameters; and wherein in the installing step, the steam relax unit is installed vertically between the first draw rolls and the second draw rolls.

15. The process according to claim 12, wherein the first and the second windup assemblies comprise a double deck windup assembly for winding said multifilament yarns on cores into packages.

16. The process according to claim 12 wherein:

the first and the second windup assemblies have a windup chuck for winding the first and the second plurality of the multifilament yarns into a first and a second plurality of packages;

the adjacent spinning assemblies include a first and a second windup assembly having a windup chuck for winding a first and a second plurality of multifilament yarns into a first and a second plurality of packages; and a horizontal distance between axes of rotation of the windup chuck in the first windup assembly in the first spinning assembly and the windup chuck in the first windup assembly in the adjacent spinning assemblies is a maximum distance of less than or equal to 1000 mm.

17. The process according to claim 12, wherein in the installing step, the steam relax unit is adapted to apply steam to the multifilament yarns without internal jets or internal multifilament yarn guides.

18. The process according to claim 12, wherein in the mounting step, the first and the second unheated rotatable stepped feed and draw roll assemblies are mirror images of one another.

19. The process according to claim 12, wherein in the mounting step, each of the unheated rotatable stepped feed and draw roll assemblies is a double stepped roll assembly.

* * * * *